United States Patent [19]

Coerper et al.

[11] Patent Number: 5,044,326

[45] Date of Patent: Sep. 3, 1991

[54] FLAMMABLE WASTE LIQUID COMBUSTION SYSTEM AND METHOD

[75] Inventors: Philip R. Coerper, Waukesha; Boris M. Tynkov, Bayside, both of Wis.

[73] Assignee: Aqua-Chem, Inc., Milwaukee, Wis.

[21] Appl. No.: 494,033

[22] Filed: Mar. 14, 1990

[51] Int. Cl.[5] ..... F22B 35/00; F23C 1/00; F23G 7/00

[52] U.S. Cl. ..... 122/4 R; 122/448.1; 110/234; 110/238; 236/14

[58] Field of Search ..... 236/15 BD, 14; 122/446, 122/447, 448 A, 448 R, 451 R, 451.1, 451.2, 452, 4 R, 448.1; 110/233, 234, 238, 262; 431/278, 281, 283, 284, 5, 12, 89, 90

[56] References Cited

U.S. PATENT DOCUMENTS

| | | | |
|---|---|---|---|
| 3,611,954 | 10/1971 | Monroe, Jr. | 110/238 |
| 3,954,381 | 5/1976 | Marecaux | 110/238 X |
| 3,980,417 | 9/1976 | Diercky | 110/238 X |
| 4,498,428 | 2/1985 | LaSpisa | 122/448.1 |
| 4,517,906 | 5/1985 | Lewis et al. | 236/15 BD X |
| 4,716,843 | 1/1988 | Coerper, Jr. et al. | 110/234 |
| 4,742,783 | 5/1988 | LaSpisa et al. | 236/15 BD X |
| 4,861,262 | 8/1989 | Gitman et al. | 431/12 X |

*Primary Examiner*—Henry A. Bennett
*Assistant Examiner*—Christopher B. Kilner
*Attorney, Agent, or Firm*—Arnold J. Ericsen; C. Thomas Sylke

[57] ABSTRACT

Apparatus is provided for controlling the burning of a volatile waste liquid together with a conventional fuel in a boiler in the form of a free-standing module which contains a flow-control valve for the waste liquid. This system includes a means for monitoring the position to the fuel-control valve for the conventional fuel and a separate means for monitoring the position of a controlled valve for feeding of the volatile liquid. The two monitoring means are coupled and comparisons are made of the relative valve positions indicated thereby. The process controller used for such comparison contols a valve which stops the flow of volatile liquid to the burner in the event that more than a predetermined discrepancy occurs between the indicated valve positions. Said controller may also be employed to correct the valve position. Other features include a reverse purge pumping system which is actuated upon shutdown of volatile fuel flow. Additionally, the entire operating range of the control valve for the volatile liquid can be shifted so that volatile fuels of varying calorific values can be accomodated.

3 Claims, 4 Drawing Sheets

FLAMMABLE WASTE LIQUID COMBUSTION SYSTEM AND METHOD

BACKGROUND OF THE INVENTION

1. Field of the Invention

The present invention relates generally to the art of burning waste liquids such as solvents or light hydrocarbon fraction liquids in packaged burners and boilers. More particularly, the system relates to the simultaneous burning of such liquids with conventional fuel such as natural gas or fuel oil.

2. Description of Related Art

Numerous manufacturing processes produce flammable liquid wastes, many of which are classified as hazardous or toxic chemicals which require costly disposal. If such flammable liquids are disposed of by various waste disposal processes, the potential energy contained in the wastes is lost, compounding the expenses entailed in the disposal process.

It is an object of the present invention to provide a safe system for the combusion of volatile liquids and solvents in which the energy of the liquid waste is utilized as a boiler fuel.

One prior art method, attempting to utilize volatile solvents and liquids as a fuel, entailed mixing those materials in fuel oil. Such fuel mixtures, are often unsatisfactory in that the solvents contain materials which are highly corrosive to control valves and other components required for the operation of the system.

Another prior art approach involves feeding a constant but limited amount of solvent to the burner. However, since such systems are unmodulated, the ratio of solvent to fuel constantly changes. At periods of low firing rates, the proportion of solvent is at maximum percentage of the total fuel being fed to the boiler. Such a situation can lead to unsafe conditions in that the waste materials may contain non-uniform amounts of moisture or other non-flammable materials which may cause the boiler to burn poorly or even go out. If such an occurrence is followed by a slug of highly volatile materials, explosive conditions can result.

Another system heretofore employed by the present inventor entailed the use of two metering pumps for a boiler, one for the conventional fuel and another for the volatile solvent. A mechanical connection was employed to cause the two valves to open and close simultaneously so that a constant proportion of volatile solvents was present in the fuel mixture. A rate of air feed to the boiler in proportion to the total amount of fuel to provide air in excess of a stoichiometric combustion mixture. While such a system has operated satisfactorily, the types of boilers on which the same can be employed is limited by the physical arrangement of the boiler and furnace components. Due to such constraints it has been hithertofore impossible or impractical to employ such systems on many boilers. A need has thus continued to exist in the art for a system which can safely and efficiently utilize solvents and volatile liquids as a fuel, and which can be attached to most or all boiler systems.

OBJECTS AND SUMMARY OF THE INVENTION

The present invention provides a separate module which contains a flow valve adapted to control of a flammable liquid to a burner, in a manner which can be operated safely and reliably and which can be used in connection with the wide variety of burners and boilers. These results are achieved by the development of control circuitry that is an integral part of the present invention.

Specifically, the present invention is adapted to be connected to a standard type boiler with a conventional fuel supply system having a control valve for controlling the rate of fuel delivery to the burner as hithertofore provided. A damper for controlling the amount air flowing into the burner is also provided as well as a control system for modulating the valve and the damper in response to the measured output of the boiler, which output is generally measured in terms of the steam pressure, boiler temperature, etc. The air and fuel are modulated together so that there is always some excess of air above a stoichiometric amount. In accordance with the present invention means such as a potentiometer provides an output for monitoring (either directly or through hard mechanical linkages) the position of the fuel control valve through which the conventional fuel is delivered. A means is also provided for feeding a volatile solvent or liquid to the burner as well as a second valve for regulating the flow of that liquid and controlling the rate of delivery thereof to the burner, preferably at a controlled rate which is at a predetermined ratio relative to the amount of flow of conventional fuel. The volatile liquid preferably provides 20 to 40 percent of the caloric value of said fuels. This second control valve is also provided with means for controlling the position thereof. A second monitoring means or circuit is provided for monitoring the actual physical position of the volatile liquid flow regulating valve or alternatively, the rate of flow of liquid through the valve. The two monitoring means are coupled together so that the relative valve positions indicated can be compared, for example, by a process controller. The comparing means is adapted to control a valve which stops the flow of the volatile liquid to the burner in the event that more than a predetermined discrepancy between the two indicated positions of the valves occurs.

In a further embodiment, the process controller further produces an output signal that can be employed to correct the position of the volatile liquid flow control valve. A further aspect of the invention is that two alternative feed lines may be provided for supplying standard fuel through its control valve. The fuel feeding pressure in each of the feed lines is different. Thus, it is possible to provide fuel at a higher pressure when only the conventional fuel is being burned but to employ a lower pressure when the conventional fuel and volatile solvent are both being burned. In a further embodiment, the means for controlling the position of the volatile liquid control valve is adjustable so that the entire operating range thereof can be shifted to accomodate volatile fuels of varying calorific values. Thus, for example, a higher flow rate at all positions of the valve can be provided in the event that a lower calorie fuel is being fed to the burner. This eliminates the need for recalibration of the entire system in the event that a variety of liquids or solvents is burned.

A further feature of the invention is that a reverse purge pump can be incorporated into the system and controlled such that the volatile liquid is purged from the burner each time that the burner shuts down or upon otherwise discontinuing the flow of volatile liquid to the burner. As the term is used herein, "conventional fuel" refers to fuel oil, natural gas, propane, or similar fuels. As the term "solvent" or "volatile liquid", as the term is used herein, is meant various such liquids which may be found in industrial waste streams, including but not limited to such materials as methanol, hexane, xylene, waste oils, paint thinners, acetone, ketones, toluene, mineral spirits, isopropanol, benzene, and the like. Such liquids frequently have low lubricity and viscosity characteristics and may have variable heating values and water content. Hithertofore, combustion of such materials has led to flame stability problems, fuel valve and supply pump failure, burner gun vapor lock, variations in excess air levels, poor control and adjustment of air/fuel ratios, improper combustion temperatures resulting in incomplete combustion and corrosion and sooting of the boiler, and a high potential for boiler explosions.

DESCRIPTION OF THE PREFERRED EMBODIMENT

Figure 1:
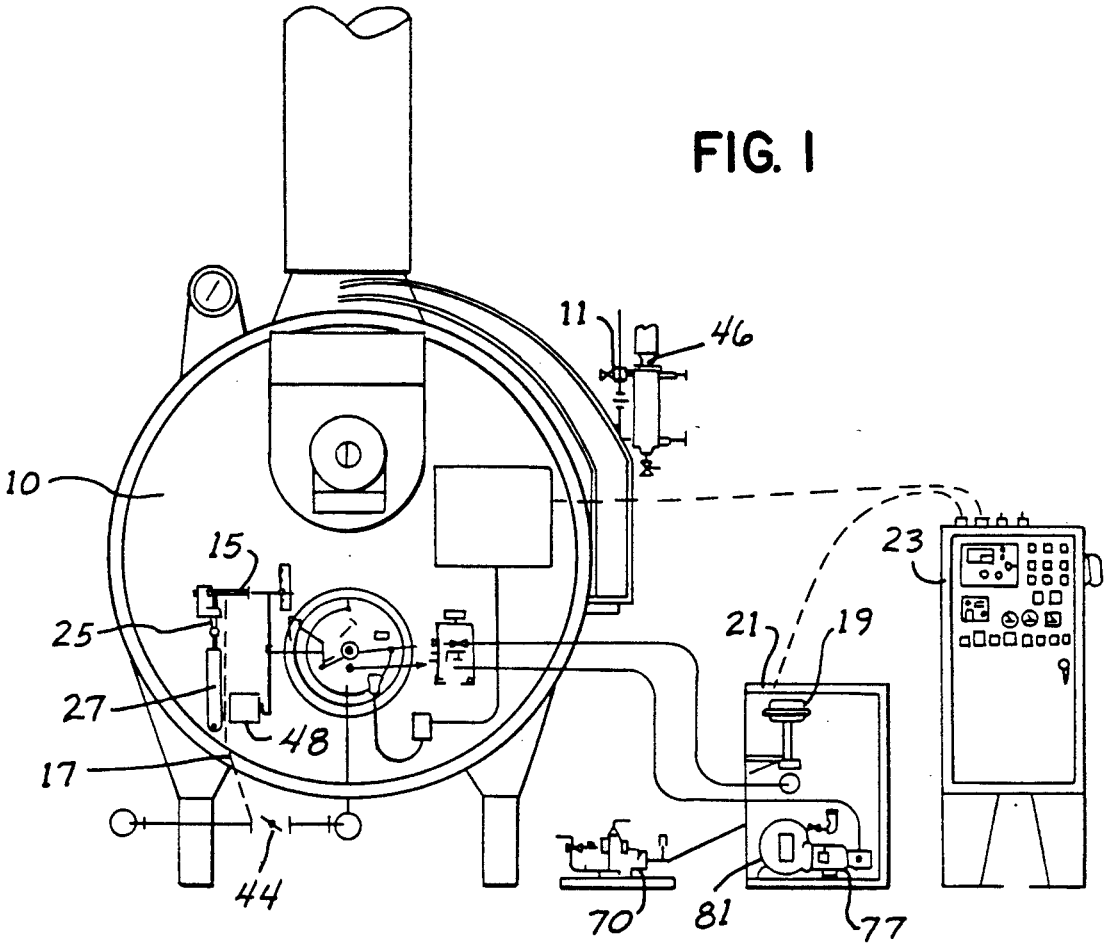
FIG. 1 is a partial plan frontal view and part schematic view of a system of the present invention.

The preferred embodiment of the system is illustrated in the various views of the drawing, in which a boiler is indicated by numeral 10 and is provided with a burner gun 12. A source 14 of natural gas or other conventional fuel is provided for firing the firing boiler 10. A stream of such fuel is also supplied to a pilot as indicated by arrow 16.

Figure 2:
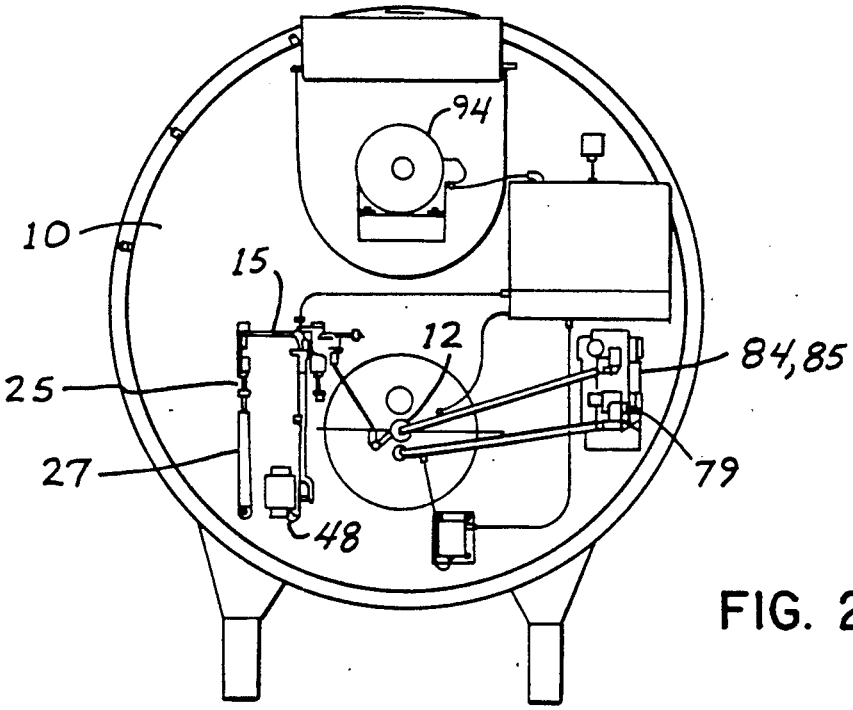
FIG. 2 is a frontal plan view of a boiler of the type illustrated in FIG. 1.

As seen in FIGS. 1 and 2, the firing rate of the boiler is controlled by an electro mechanical pressure switch 11 that senses steam pressure and signals a modulation motor 48 on the front of the boiler mechanically connected to a jackshaft 15. Also connected to jackshaft 15 is hard linkage 17 for natural gas or other fuel control valves.

When firing a flammable liquid, a special flow control valve 19 is required due to the low lubricity and potential corrosive nature of the fuel. Because of the size of these valves and the numerous different types of front head arrangements on the boilers, it is not feasible to mount this valve on the front of the boilers. The flow valve with the other flammable liquid equipment are positioned in a free-standing module 21. Various control switches and indicators are placed on a separate control panel module 23. Flow control valve 19 is preferably constructed of a corrosion resistant material such as stainless steel.

Attached to jackshaft 15 is an adjustable cam 25 of the general type shown in U.S. Pat. No. 3,685,364 issued Aug. 22, 1972. A heavy-duty potentiometer 27 is actuated by cam 25 and a voltage signal based on the firing rate is generated. This signal is preferably altered to 4 to 20 MA and then put across a current/pressure transducer 91 by a voltage/current device 53 creating a pneumatic signal to control the position of valve 19. As a safety feature, an additional mechanical indicating device 92 is mounted on the valve to create a electrical current signal based on actual position of the fuel valve 19. This signal is then compared with the jackshaft potentiometer signal for example, by process controller 93 to verify the valve position.

Also included in the circuit is separate potentiometer 52 which provides a bias feature that allows adjustment of the overall range of the valve movement. This feature is used to adjust the system if the heating value or calorific content of the fuel changes.

Two separate and alternative flow paths 18 and 20 are provided for flow of the natural gas. Flow path 18 is used when conventional fuel only is burned and is controlled by a pressure control valve 22. A separate pressure control valve 24 controls alternative flow path 20 which is used when both conventional fuel and waste volatile liquids are burned. Pressure indicators 26 and 28 are provided to allow monitoring of the pressures in the flow lines. A pneumatic flow valve 30 of a three-way type is provided to allow selection of the desired mode of firing. A separate hand-operated valve 32 is also be provided for manual shutoff and to allow isolation of line segment. A low pressure switch 34 is provided so as to cause the system to shut down in the event that the gas pressure drops below a predetermined minimum pressure, and high pressure switch 35 causes a shutdown in the event the pressure rises above an acceptable level. A second set of pressure switches 36 are also provided to electronically sense the natural gas pressure when firing with volatile liquid. Motorized valves 38 and 40 are also provided to shut off the fuel line when required. A further manual valve 42 is provided to allow isolation of desired portions of the system. A butterfly valve 44 is controlled by signals 46 emanating from the steam pressure controller. Such signals actuate a modulating motor 48 to control butterfly valve 44. Potentiometer 27 and bias flow controller 52 are utilized to modulate the flow of volatile liquid in conjunction with the modulation of the natural gas flow.

Figure 3:
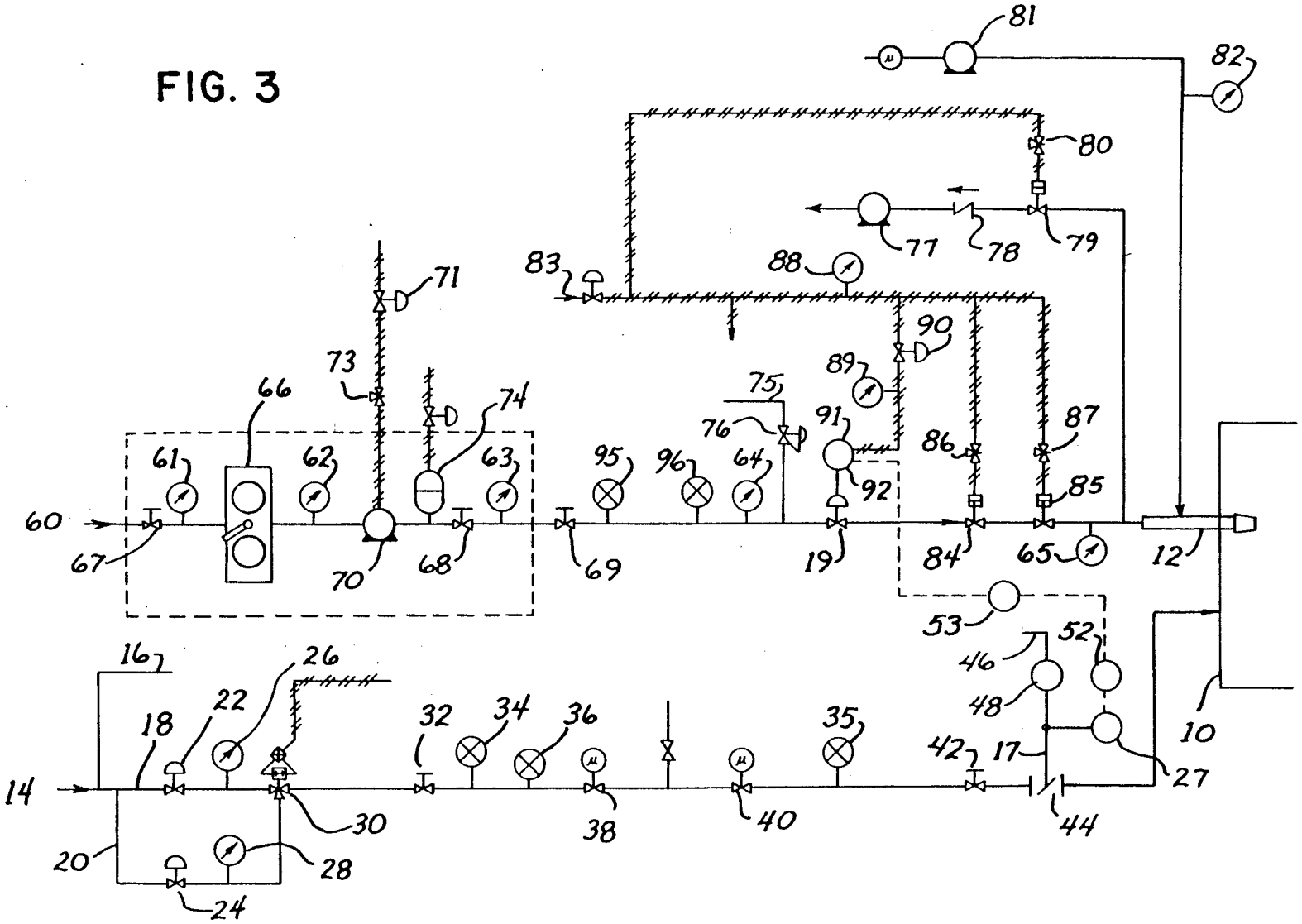
FIG. 3 is a schematic view of a flammable liquid combustion system according to the present invention.
Figure 4:
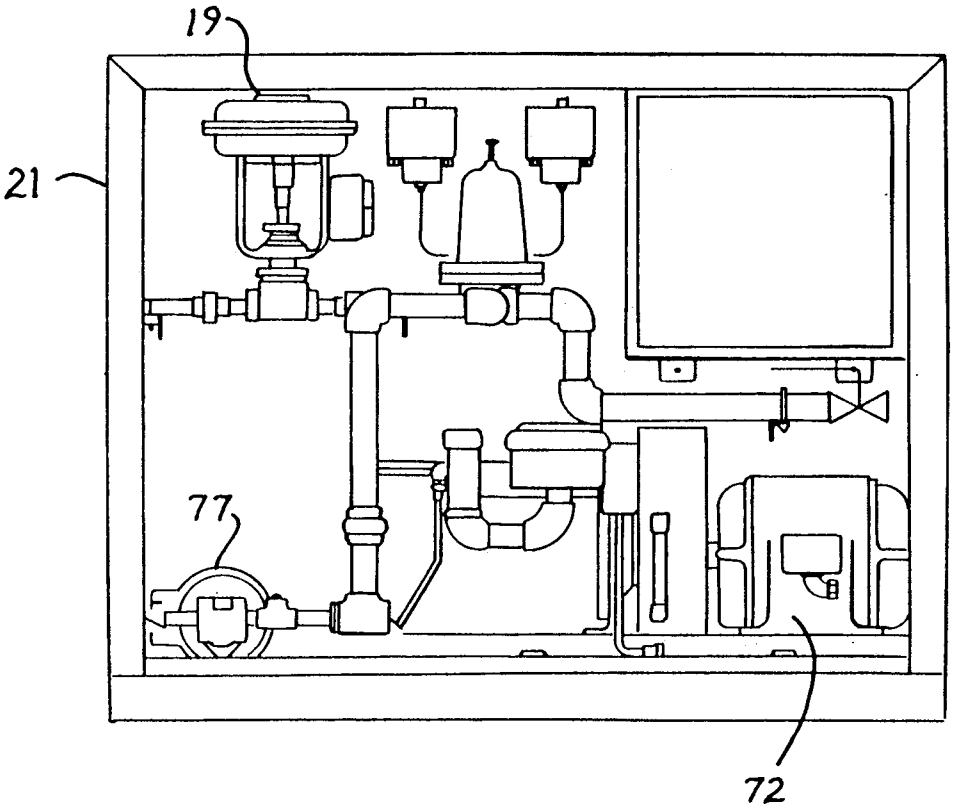
FIG. 4 is a frontal view of a free standing modular volatile liquid controlling component of the system of the present invention.
Figure 5:
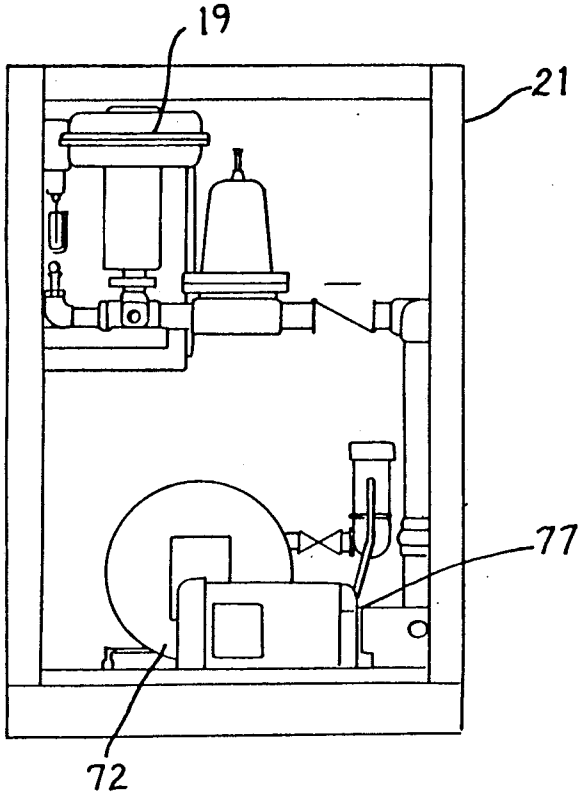
FIG. 5 is an end view of the modular component of FIG. 4.
Figure 6:
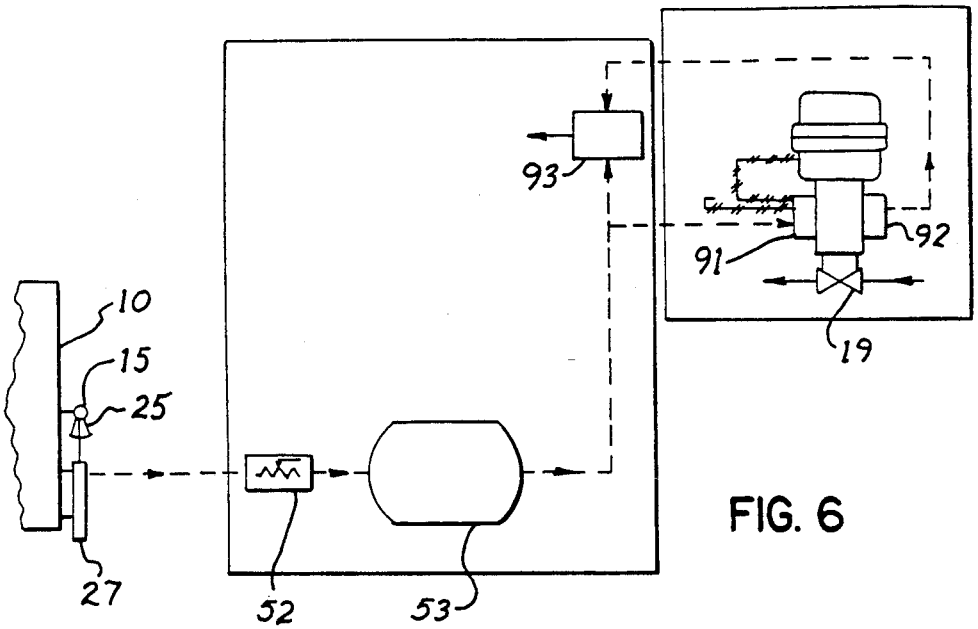
FIG. 6 is a schematic view illustrating the preferred process control system in accordance with the invention; and, FIG. 7 is a schematic view illustrating an alternative embodiment of the invention.

A source of volatile waste liquid is shown by arrow 60 in FIG. 3. Pressure indicators 61, 62, 63, 64 and 65 are placed along the path of flow of said liquids so that the same can be carefully monitored. As also shown in FIG. 3, a straining means such as a duplex strainer 66 is preferably installed on the inflow line to remove solid particles and similar impurities from the waste liquid. A series of hand-operated or manual valves 67, 68 and 69 are installed along the flow path of the volatile liquid to permit isolation of desired of segments of the flow path.

A waste pump 70 causes the stream 60 of volatile liquid to flow into nozzle 12. A pressure control valve 71 controls a flow of compressed air to the waste pump 70. The flow of compressed air is further controlled by a flow control valve 73. In practice, it is desirable to also use a surge suppressor 74 to suppress pulsations to the waste pump 70. A return line 75 is provided to allow recycling of volatile liquid to the supply tank. A pressure control valve 76 is provided to maintain a constant pressure on the inlet side of valve 19.

The system is also provided with a reverse purge pump 77, which together with valve 79, is actuated each time the flow of volatile liquid to the nozzle is stopped. Such reverse purging avoids vapor lock in the nozzle and reduces the likelihood of explosive conditions from occurring. Preferably a check valve 78 is installed on the inlet line to the purge pump. Valve 79 is actuated by a selenoid 80.

Atomizing air compressor 81 is provided to provide a supply of air to burner nozzle 12 to assure atomization of the fuel. A pressure indicator 82 is provided to indicate the pressure within the air line. Low pressure alarms and switches, not shown, can also be provided on said line.

Arrow 83 indicates a supply of compressed ambient air used to supply the various pneumatically operated valves used in the system including valve 79 and additional valve 84 and 85 on the volatile liquid line which are controlled by a pneumatic flow valves 86 and 87, respectively. Additional pressure indicators 88 and 89 are also provided in the system. Main flow control valve 19 is also actuated by a pressure control valve 90 which is similarly supplied with ambient air through intake source 83. Valve 19 is preferably driven by a current to pneumatic transducer 91 which in the preferred embodiment converts a 4–20 milliamp system output to a 3–15 PSI signal to cause opening and closing of valve 19.

OPERATION

In operation, the boiler 10 signals steam demand by means of a signal 46. The boiler will fire by first starting combustion air blower motor 94 to pre-purge the boiler 10 with air, providing four furnace volumes of clean combustion air going through the boiler. The firing sequence starts with the boiler V at low fire. Standard fuel valve 38 and 40 are opened, feeding the standard fuel through regulator 24 at reduced rates because of reduced pressure being supplied to that line. Then, after the natural gas is introduced at the reduced rate, the two valves 84 and 85 open to cause firing of the volatile liquid. After an adjustable time delay of about ten seconds, the boiler will modulate up to a full firing rate in order to satisfy the steam demand. With turning of jackshaft 15, the flow valve 19 for the volatile liquid will modulate together with flow valve 24 to satisfy the firing rate of the boiler. At such a time that the boiler is satisfied, the boiler will modulate back down to low fire and the fuel shutoff valves 38, 40, 84 and 85 will be closed and at that time the purge valve 79 will open and the purge pump 77 will be engaged to pull back the volatile liquids out of the gun 12 and return them to the tank. Also provided is a post purge cycle wherein the combustion air will be supplied to burner 12 for a few seconds to purge the boiler with air. The boiler is then ready to start up again when demand is once again signaled. The system is provided with interlocks consisting of pressure switches 34 and 35 that monitor the pressure of the standard fuel and switches 95 and 96 which perform a similar function with respect to the volatile liquid line. These are set just outside the range of the operation of the desired fuel pressures to assure that there is not a failure in the pressure regulators. The supply of fuel is thus shut off if the line pressure is either too low or too high in operation the flow rates of the fuels are thus controlled with the firing of the burner being modulated in response to the demand of the boiler for steam by opening and closing the valves proportionately to provide an approximately fixed ratio of the caloric heating valve of the fuels of approximately 50 to 80 percent conventional fuel to approximately 20 to 40 percent volatile liquid.

In the event that the flammable liquid pressure switches and the running interlocks indicate a failure, the natural gas would keep firing. In the event of a similar failure on the natural gas side, the entire boiler system would shutdown immediately causing the fuel shutoff valves to close and the purge system to engage. An audible alarm would also sound requiring resetting of the system and identification of the failure.

Figure 7:
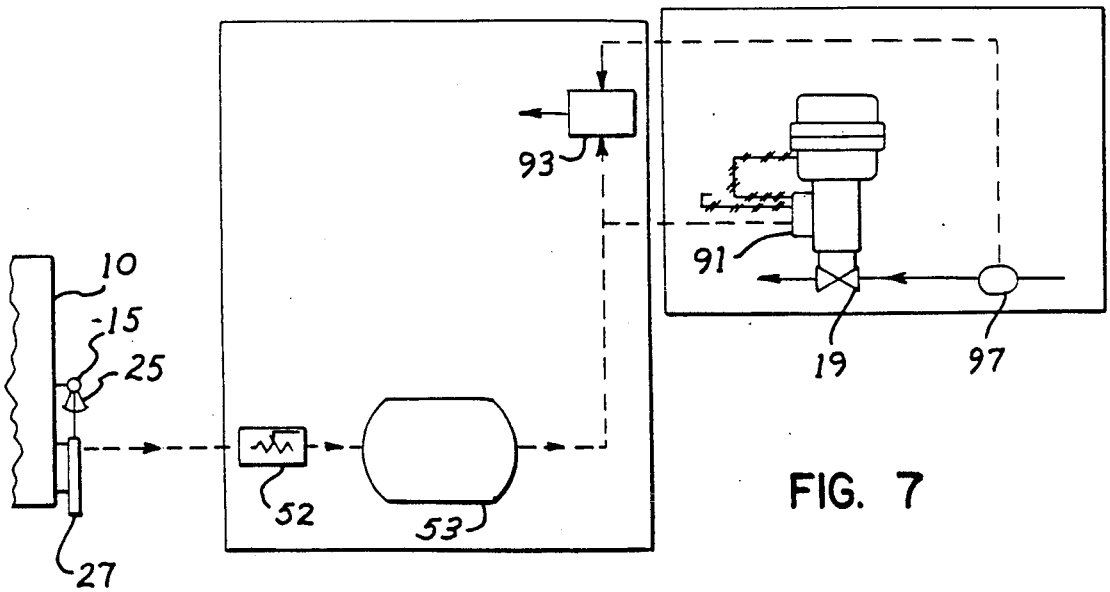

As seen on FIG. 7, the means for monitoring the position of valve 19 can alternatively be a flow rate transmitter 97 which can be used to transmit signals to process controller 93 to be compared with those received from voltage/current device 53. It will be apparent that if process controller 93 determines a discrepancy between the firing rate and boiler 10 and the position of valve 19 that a signal can be transmitted by process controller 93 back to the regulator which controls valve 19 in order to correct the position of valve 19. Then, if for any reason, such correction is ineffective, the controller 93 can produce a signal causing the system to shut down as herein before described.

What is claimed is:

1. A method of burning a volatile organic waste liquid in a boiler comprising (a) providing a supply of a conventional fuel controlled by a first valve to the burner of said boiler, (b) providing a supply of air to said burner, (c) providing a flow of volatile organic waste liquid to said burner controlled by a second valve, (d) modulating the rate of firing of said burner in response to the demand for steam on said boiler by opening and closing said first and second valves proportionately to provide an approximately fixed ratio of the caloric heating value of said fuels of approximately 50 to 80 percent conventional fuel to approximately 20 to 40 percent volatile liquid, and maintaining an approximately constant excess of air to sand burner, (e) monitoring the position of said first control valve, (f) monitoring the position of said second flow regulating valve, (g) comparing the relative valve positions indicated by said two monitoring means and (h) stopping the flow of said volatile liquid to said burner in the event that more than a predetermined discrepancy between the indicated positions of said valves occurs.

2. A method according claim 1 wherein the monitoring of said second valve is effected by measuring the fluid flow rate through said valve and converting said measurement to an electrical signal.

3. A method according to claim 1 wherein the monitoring of said second valve is effected by measuring the position of a mechanical component coupled to said valve.

* * * * *